US005078081A

United States Patent [19]

Kustermann

[11] Patent Number: 5,078,081

[45] Date of Patent: Jan. 7, 1992

[54] DEVICE FOR COATING A MATERIAL WEB

[75] Inventor: Martin Kustermann, Heidenheim, Fed. Rep. of Germany

[73] Assignee: J. M. Voith GmbH, Heidenheim, Fed. Rep. of Germany

[21] Appl. No.: 540,476

[22] Filed: Jun. 19, 1990

[30] Foreign Application Priority Data

Jun. 22, 1989 [DE] Fed. Rep. of Germany ..... 3920381
Dec. 22, 1989 [DE] Fed. Rep. of Germany ..... 3942590

[51] Int. Cl.[5] ..... B05C 3/18; B05C 11/04
[52] U.S. Cl. ..... 118/119; 118/126; 118/414; 118/419
[58] Field of Search ..... 118/110, 112, 118, 119, 118/126, 413, 419, 414

[56] References Cited

U.S. PATENT DOCUMENTS

| | | | |
|---|---|---|---|
| 4,405,661 | 9/1983 | Alheid | 118/413 |
| 4,643,127 | 2/1987 | Wanke | 118/126 |
| 4,688,516 | 8/1987 | Sommer | 118/413 |
| 4,702,196 | 10/1987 | Kratzberger | 118/413 |
| 4,791,879 | 12/1988 | Eklund et al. | 118/413 |
| 4,873,939 | 10/1989 | Eskelinen | 118/413 |
| 4,903,632 | 2/1990 | Sollinger | 118/126 |

FOREIGN PATENT DOCUMENTS

| | | | |
|---|---|---|---|
| 289824 | 11/1988 | European Pat. Off. . | |
| 1964908 | 8/1970 | Fed. Rep. of Germany | 118/414 |
| 47-7727 | 3/1972 | Japan | 118/126 |

*Primary Examiner*—Jay H. Woo
*Assistant Examiner*—Khanh P. Nguyen
*Attorney, Agent, or Firm*—Baker & Daniels

[57] ABSTRACT

On a coating device, at the mouth originating from the chamber for the coating substance, there is provided, between said mouth and the backing roll or web, a cover body which on its surface near the mouth forms an outlet channel that extends away from the space through which at the doctor blade flows the coating substance. This outlet channel has a throttle effect. Additionally, the cover body forms relative to the doctor blade a second throttle channel which is located relatively close to the smoothing edge of the doctor blade. At the outlet of the second throttle channel, the cover body preferably extends into a point which is arranged relatively close to the backing roll or web. The outlet channel can suitably be formed between a base body and the cover body, with the base body ending at a distance from the doctor blade that is maximally 10 mm greater than the clearance of the second throttle channel.

20 Claims, 3 Drawing Sheets

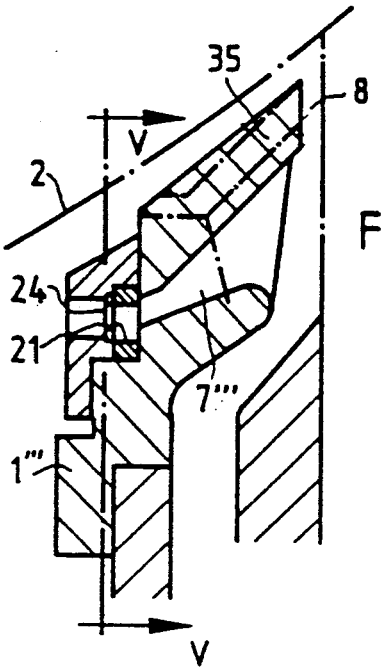
Fig. 4.
Fig. 5
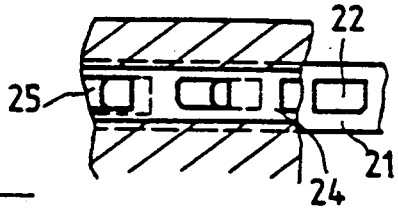
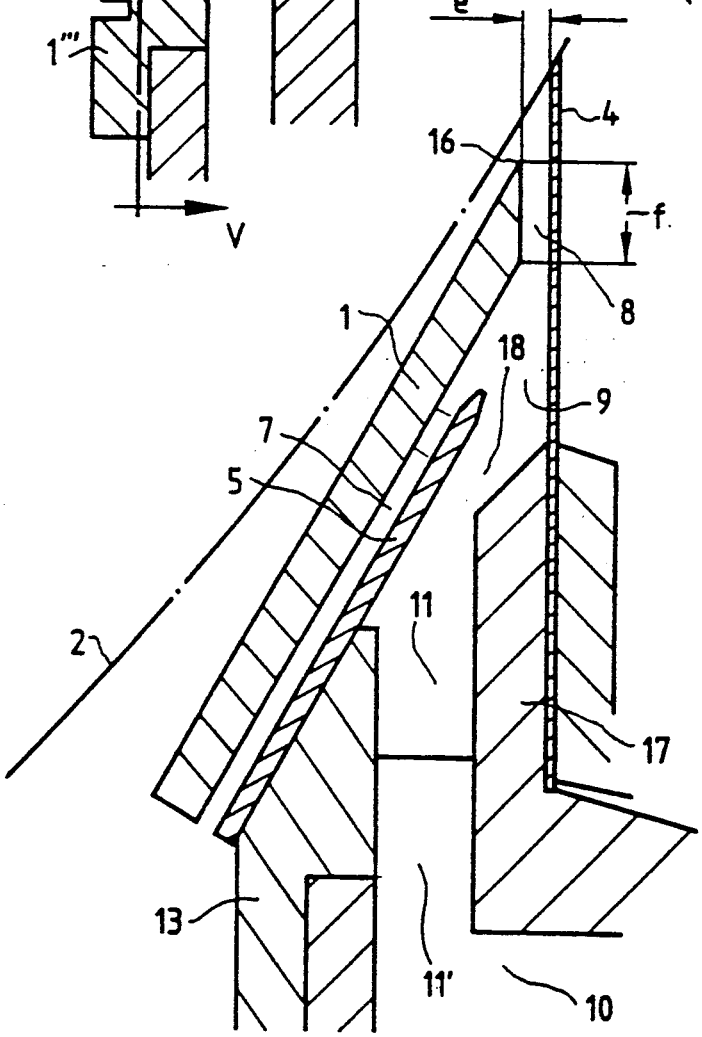
Fig. 1

Fig. 3
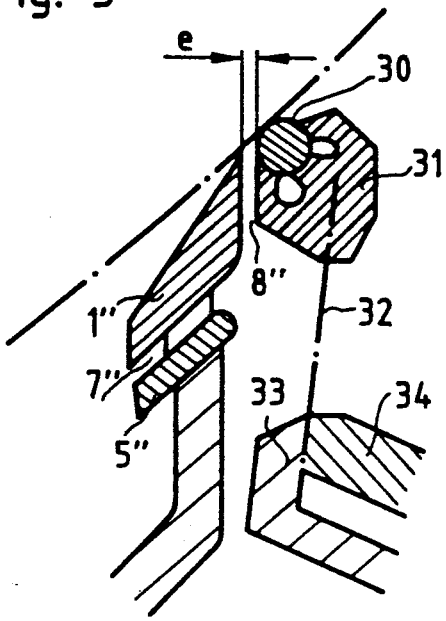
Fig. 2
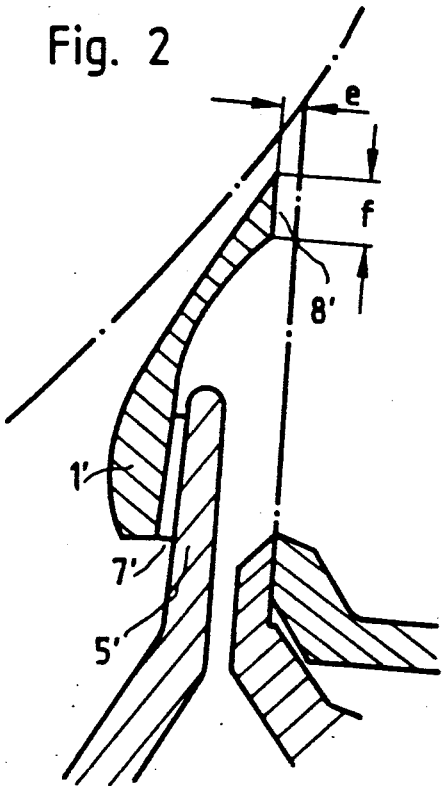
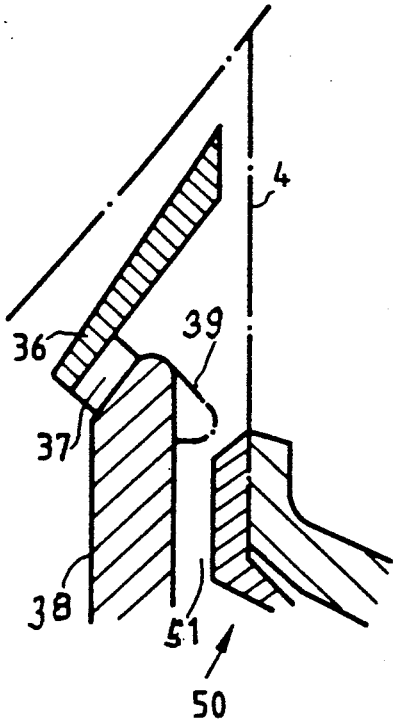
Fig. 6

DEVICE FOR COATING A MATERIAL WEB

BACKGROUND OF THE INVENTION

The invention concerns a coating device for material webs of, for example, paper or cardboard wherein a doctor blade or doctor roll acts on the web in the area of a backing roll carrying the web, or acts directly on the backing roll. An applicator chamber for the coating substance is provided in which the coating substance can be fed to the web or the backing roll, or to the doctor blade or doctor roll through a mouth that extends parallel to the web or the backing roll across the width of the web.

Such a coating device is known from DE-C 35 13 063. In the case of this coater there is provided, at the doctor blade and the backing roll supporting the material web, a relatively large and spacious application space which on the entrance side of the material web is defined by a front wall that features outlet openings. This front wall extends toward the backing wall so as to almost make contact with it. The document says nothing about the purpose of these outlet openings.

The problem underlying the invention is to improve on such or similar coaters (see also German application P 36 12 248), the quality of the applied coating in terms of uniformity. Due to the high web speeds it appears to be difficult with the prior applicator devices of the categorial type to prevent the occurrence of turbulences in the coating substance.

SUMMARY OF THE INVENTION

This problem is inventionally solved by the present invention. According to the present invention, a coating device for coating a material web supported by a backing roll is provided. The coating device includes an applicator chamber for holding a coating substance at higher than atmospheric pressure. The coating substance is fed from the chamber to the web or backing roll through a mouth extending parallel to and across the width of the web or backing roll. A doctor blade having a coating edge acting on the web or acting directly on the backing roll in an area of the backing roll carrying the web is provided. A cover body is arranged in closely spaced relationship to the backing roll, and is positioned between the backing roll and the mouth. Between the cover body and the doctor blade is an applicator space at above-atmospheric pressure. The cover body separates the applicator space from the backing roll, wherein the cover body forms a first throttle channel distributed across the length of said backing roll. The first throttle channel extends away from the applicator space and has the coating substance flowing therethrough. The throttle channel is generally slot-shaped and positioned parallel to the longitudinal center axis of the backing roll wherein the throttle channel has a throttle effect. The cover body further forms a second throttle channel relative to the doctor blade. The second throttle channel is generally slot-shaped in section parallel to said longitudinal center axis of said backing roll.

BRIEF DESCRIPTION OF THE DRAWINGS

The invention will be explained hereafter with the aid of several embodiments illustrated in the drawing.

FIG. 1, shows a cross sectional view of the coating device according to the present invention;

FIG. 2, shows another embodiment in a view similar to FIG.1;

FIG. 3, shows another embodiment;

FIG. 4, shows still another embodiment with a throttle slide;

FIG. 5, shows a partly longitudinal sectional view of FIG. 4 along the sectional reference there;

FIG. 6, shows another embodiment similar to FIG. 2; and

Figure 7:
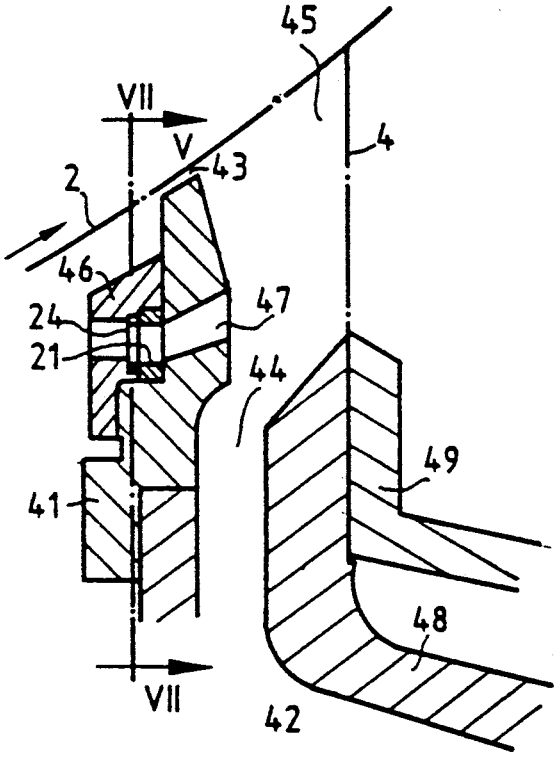
FIG. 7 and 7*a*, show an embodiment similar to FIG. 4 and 5.

Corresponding reference characters indicate corresponding parts throughout the several views of the drawings. The exemplifications set out herein illustrate preferred embodiments of the invention, and such exemplifications are not to be construed as limiting the scope of the disclosure or the scope of the invention in any manner.

DESCRIPTION OF THE PREFERRED EMBODIMENT

Referring now to the drawings, the material web is carried by the backing roll 2 in the range of the doctor blade 4. The coating substance proceeds from the chamber 10 through the mouth channel 11' to the mouth 11, and from there to the doctor blade. The coating substance is fed at a certain surplus which, however, in this case may be considerably smaller than in the case of prior coaters. An upper plate 1, as a cover body, forms relative to the doctor blade 4 a throttle gap or channel 8 of a width between 3 and 15 mm, preferably between 5 and 8 mm. The length of this channel amounts to between 5 and 25 mm, preferably between 5 and 15 mm. The point 16 of the plate 1, that is, the edge which is rounded maximally with a radius of 1 mm and is near the backing roll. is spaced from the backing roll 2 about 2 through 10 mm.

The plate 1 forms together with another plate 5, as a base cover or body, another throttle channel (outlet channel) 7 that extends away from the applicator space 9 at the doctor blade 4, where the coating substance flows from the mouth 11 to the stripping edge of the doctor blade, which throttle channel 7 extends essentially in the area between the mouth 11 and the front defining wall 13 of the mouth 11, or the mouth channel 11', and the chamber 10. Its height is approximately between 3 and 6 mm while its length is essentially between 10 and 20 times the stated height. Base body 5 on its edge near the doctor blade 4 where the doctor blade holder is rounded in the area of a first throttle channel with a radius of at least 5 mm.

In sections parallel to the longitudinal center axis of the backing roll 2, the throttle channels are practically slot-shaped because in this direction they have an overall length corresponding to the length of the backing roll which, for instance, with a backing roll 2 length of 8 m, and a channel (slot) height of 5 or 8 mm (shown in the drawings as "e"), exceeds the latter by orders of magnitude (see also FIG. 5).

Located between the back wall 17 of the mouth channel 11' and the second plate 5, in the area of the latter, is preferably a constriction point 18. This makes it possible to make the flow of the coating substance even more uniform. Throttle channel 7 essentially permits the coating substance supplied at a surplus to drain.

The coating substance may also be fed directly to the roll 2 by the applicator chamber, in which case the roll is then looped or contacted by the material web in another area where the transfer of the coating substance to the material web takes place.

For the sake of completeness, FIG. 2 illustrates another possible embodiment of base body and cover body. The reference numerals are provided each with an additional apostrophe. The throttle channels meet their respective requirements wherein second throttle channel 8 may have a length "f" in the flow direction along the doctor blade 4 or doctor blade holder between 5 and 25 mm, and preferably between 5 and 15 mm, and a width "e" between 3 and 15 mm, preferably between 5 and 8 mm.

The embodiment shown in FIG. 3 shows that a roll type blade 30 may also be used as a doctor element. Blade 30 is rotatably mounted in a doctor bed 31 which is fastened to a support spring 32 in the doctor blade holder 33, 34 fashioned as a leaf spring. The cover body 1", forms the second throttle channel 8", opposite the holder 31 of the roll type doctor blade 30.

FIG. 4 and 5 show that the throttle channel 7", may be controlled in its throttling by a throttle slide 21 having throttle windows 22. Coordinated with each slide is a throttle bar 24 having appropriate windows 25. The throttle effect of the throttle channel may also essentially be based solely on the effect of this slide 21. Naturally, this embodiment can be adapted in a very comprehensive way to varied conditions of the coating process, for instance also to the parameters of the coating substance, such as its consistency.

Illustrated in FIG. 6 is another embodiment of the present invention, where the cover body 36, with a very thick front wall 38 of the mouth 51 of the chamber 50 for the coating substance, directly forms the first throttle channel 37. This is especially favorable when this front wall 38 is an essential supporting component of the coater or of the support bar for the doctor blade 4. The dash-dotted line illustrates how a constriction point can be formed at the exit of the mouth channel 51 by a nose-shaped projection 39 of the front wall 38.

The doctor blade 4 is customarily adjusted by means of a thrust component which acts on its free area and which along the axis of the backing roll, or the width of the paper web, may also be subdivided so as to exert various contact pressures on the doctor blade 4. This causes a deflection of the doctor blade, which might result in a rather heavy change of the second throttle channel 8, 8', 8" etc., in its dimension. This is precluded when using a coater where the contact angle of the doctor blade 4 on the backing roll or paper web is kept constant by appropriate pivoting conditions. Such a device is known, among others, from the U.S. Pat. document No. 4,637,338.

A number of other design possibilities in this respect are known. In the case of these devices, the support bar along with the chamber for the coating substance, including its mouth, is pivoted into the application zone. Thus, also the cover body and, as the case may be, the base body are pivoted to the same degree as the angular position of the doctor blade mounting changes. As a result, the conditions are essentially also retained in the area of the second throttle channel, for all operating conditions, so that the dimensions of the second throttle channel will not essentially change.

Figure 7A:
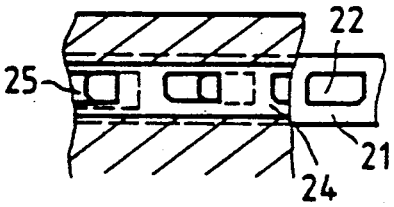

FIG. 7 and 7*a* illustrate in cross section and longitudinal section, respectively, a setup wherein the coating substance is fed to a pressure space 45 that is arranged at the doctor blade 4 and the backing roll 2 also from an applicator chamber 42, through its mouth 44. Thus, the material web carried by the backing roll 2, or the roll surface itself, is coated in the pressure space here as well, with the coating substance that is dosed and smoothed by the doctor blade 4. The necessary surplus share of coating substance flows by way of the openings or the channel 47 of the front wall 41 which defines the pressure space on the entrance side of the material web or the roll surface to the choking point that is formed by the throttle slide 24 with throttle openings 25, or by the throttle bar 21 with throttle openings 22. Thus, the excess coating substance can be drained from the pressure space 45 in a controlled manner.

Additionally, the front wall 41 preferably forms at the backing roll 2 a throttle gap 43 which has a throttle effect so heavy that only an extremely limited amount of coating substance will issue here. An effective dosing device is thereby obtained that produces a relatively smooth and undisturbed coating with a relatively simple design of the setup. In addition, lateral seals, arranged at the ends of the backing roll, can be installed easily.

The throttle slide or the components of the throttle device are fixed on the front wall 41 by a clamping bar 46. The adjustment devices and the slide 24 are not illustrated here. The clamping of the doctor blade 4 is accomplished with the aid of an extension of the wall 48 of the applicator chamber 42 and a clamping lever 49. For the sake of completeness, the direction of motion of the backing roll is additionally indicated by an arrow.

When first coating the roll surface with the inventional device, the application layer can then be transferred to a paper web. In this regard, reference may be made to U.S. Pat. document No. 4,848,268.

It will be appreciated that the foregoing is presented by way of illustration only, and not by way of any limitation, and that various alternatives and modifications may be made to the illustrated embodiments without departing from the spirit of the invention and the scope of the appended claims.

What is claimed is:

1. A coating device for coating a material web supported by a backing roll, comprising:

an applicator chamber for holding a coating substance at higher than atmospheric pressure, and from which chamber said coating substance is fed to the web or backing roll through a mouth extending parallel to and across the width of said web or backing roll;

a doctor blade having a coating edge acting on said web, or acting directly on said backing roll in an area of the backing roll carrying said web;

a cover body arranged in closely spaced relationship to said backing roll and positioned between said backing roll and said mouth, said cover body and said doctor blade defining an applicator space at above-atmospheric pressure therebetween, said cover body separating said applicator space from said backing roll; and a base body situated between said mouth and said cover body, said base body and said cover body having respective surfaces facing each other aligned generally parallel to the central axis of said backing roll, wherein said respective facing surfaces define a first throttle channel therebetween, said throttle channel being distributed across the length of said backing roll, and wherein a second throttle channel is positioned generally between an end of said cover body and the coating edge of said doctor blade, said first throttle channel further extending away from said applicator space and having a surplus of said coating substance discharged from said applicator chamber flowing therethrough, said first throttle channel being generally slot-shaped in section and having a throttle effect, said second throttle channel being generally slot-shaped in section parallel to said longitudinal center axis of said backing roll.

2. The coating device as described in claim 1, wherein said doctor blade comprises a doctor roll, said doctor roll being rotatably mounted in a doctor holder.

3. The coating device as described in claim 1, wherein said coating substance is applied directly to said backing roll.

4. The coating device as described in claim 1, wherein said second throttle channel has a length of between 5 and 25 mm in the direction of flow of said coating substance along said doctor blade, and a width of between 3 and 15 mm.

5. The coating device as described in claim 1, wherein said end of said cover body has an edge having a radius of maximally 2 mm, and which edge is spaced from said backing roll a distance of between 3 and 15 mm.

6. The coating device as described in claim 5, wherein said radius is about 1 mm.

7. The coating device as described in claim 5, wherein said edge is spaced from said backing roll a distance of between 5 and 10 mm.

8. The coating device as described in claim 4, in which said base body has an edge closely spaced from said doctor blade, said edge being rounded in the area of said first throttle channel and having a radius of at least 5 mm.

9. The coating device as described in claim 1, wherein said first throttle channel has a width of between 3 and 6 mm.

10. The coating device as described in claim 4, wherein said first throttle channel has a width of between 3 and 6 mm.

11. The coating device as described in claim 5, wherein said first throttle channel has a width of between 3 and 6 mm.

12. The coating device as described in claim 9, wherein said first throttle channel has a length of 10 to 20 times the height of said channel.

13. The coating device as described in claim 10, wherein said first throttle channel has a length of 10 to 20 times the height of said channel.

14. The coating device as described in claim 1, wherein said first throttle channel has a controllable throttle effect by means of a throttle slide, said throttle slide having throttle openings.

15. The coating device as described in claim 10, wherein said first throttle channel has a controllable throttle effect by means of a throttle slide, said throttle slide having throttle openings.

16. The coating device as described in claim 13, wherein said first throttle channel has a controllable throttle effect by means of a throttle slide, said throttle slide having throttle openings.

17. The coating device as described in claim 5, wherein said first throttle channel has a controllable throttle effect by means of a throttle slide, said throttle slide having throttle openings.

18. The coating device as described in claim 11, wherein said first throttle channel has a controllable throttle effect by means of a throttle slide, said throttle slide having throttle openings.

19. The coating device as described in claim 12, wherein said first throttle channel has a controllable throttle effect by means of a throttle slide, said throttle slide having throttle openings.

20. The coating device as described in claim 1, in which said cover body, said first throttle channel, and said second throttle channel extend substantially across the length of said doctor blade, said cover body having a generally plate-shaped or bowl-shaped configuration, and wherein the distance of said cover body from a contact edge of said doctor blade and said backing roll increases steadily at least 1 mm from said backing roll per each 10 mm of spacing from said contact edge.

* * * * *